US005326339A

United States Patent [19]

Wang

[11] Patent Number: 5,326,339

[45] Date of Patent: Jul. 5, 1994

[54] EXERCISING MACHINE CARRYING WHEEL ASSEMBLY

[75] Inventor: Leao Wang, Taichung Hsien, Taiwan

[73] Assignee: Greenmaster Industrial Corporation, Taichung Hsien, Taiwan

[21] Appl. No.: 419

[22] Filed: Jan. 4, 1993

[51] Int. Cl.[5] ..... A63B 22/06

[52] U.S. Cl. ..... 482/57; 482/52; 280/47.34

[58] Field of Search ..... 482/57, 59, 62, 63, 482/64, 65, 52, 53, 54; 280/38, 47.34, 47.35; 248/98, 129

[56] References Cited

U.S. PATENT DOCUMENTS 2,456,939 12/1948 Haase ..... 280/47.34

4,733,858 3/1988 Lan ..... 482/70

4,805,901 2/1989 Kulick ..... 482/63

*Primary Examiner*—Stephen R. Crow

*Attorney, Agent, or Firm*—Bacon & Thomas

[57] ABSTRACT

An exercising machine carrying wheel assembly is disclosed including a tubular wheel frame, which has two central shafts aligned at two opposite ends, wheels respectively mounted on the central shafts and locked in place by cotter pins, washers respectively mounted on the central shafts and retained between the stepped wheels and respective inside flanges inside the tubular wheel frame, protective caps respectively covered on the wheels, and a mounting frame welded to the wheel frame at right angles, a mounting frame connected to the base of an exercising machine by screws for permitting it to be carried on the protective caps and moved from place to place.

2 Claims, 4 Drawing Sheets

EXERCISING MACHINE CARRYING WHEEL ASSEMBLY

BACKGROUND OF THE INVENTION

The present invention relates to a wheel assembly, and relates more particularly to an exercising machine carrying wheel assembly fastened to the base of an exercising machine for permitting it to be carrying from place to place.

Various exercising machines have been proposed for use in physical exercise, and have appeared on the market. A ordinary exercising machine is heavy and difficult to move from place to place. If simply fasten wheels to the base of an exercising machine in order to let it be moved from place to place, the exercising machine may become unstable as it is being operated. FIG. 1 illustrates an exercising machine carrying wheel assembly for use in carrying an exercising machine, which comprises curved wheel frames fastened to the rear cross rod of the I-beam base of an exercising machine, and rollers respectively fastened to the wheel frames. The rollers are disposed at an elevation above the bottom edge of the I-beam base. Because the rollers are disposed at an elevation above the bottom edge of the I-beam base, it needs much labor to lift the front end of the I-beam base from the ground for permitting the exercising machine to be carried on the rollers. Further, because the rollers project outwards, the sense of beauty of the exercising machine is destroyed, and much storage space is needed during the delivery of the exercising machine.

SUMMARY OF THE INVENTION

The present invention eliminates the aforesaid disadvantages. It is an object of the present invention to provide an exercising machine carrying wheel assembly which allows an exercising machine to be conveniently carried from place to place with less labor. It is another object of the present invention to provide an exercising machine carrying wheel assembly which does not affect the stability of an exercising machine as it is being operated. It is still another object of the present invention to provide an exercising machine carrying wheel assembly which has protective caps covered on the wheels thereof for protection as well as decoration.

DETAILED DESCRIPTION OF THE PREFERRED EMBODIMENT

Figure 1:
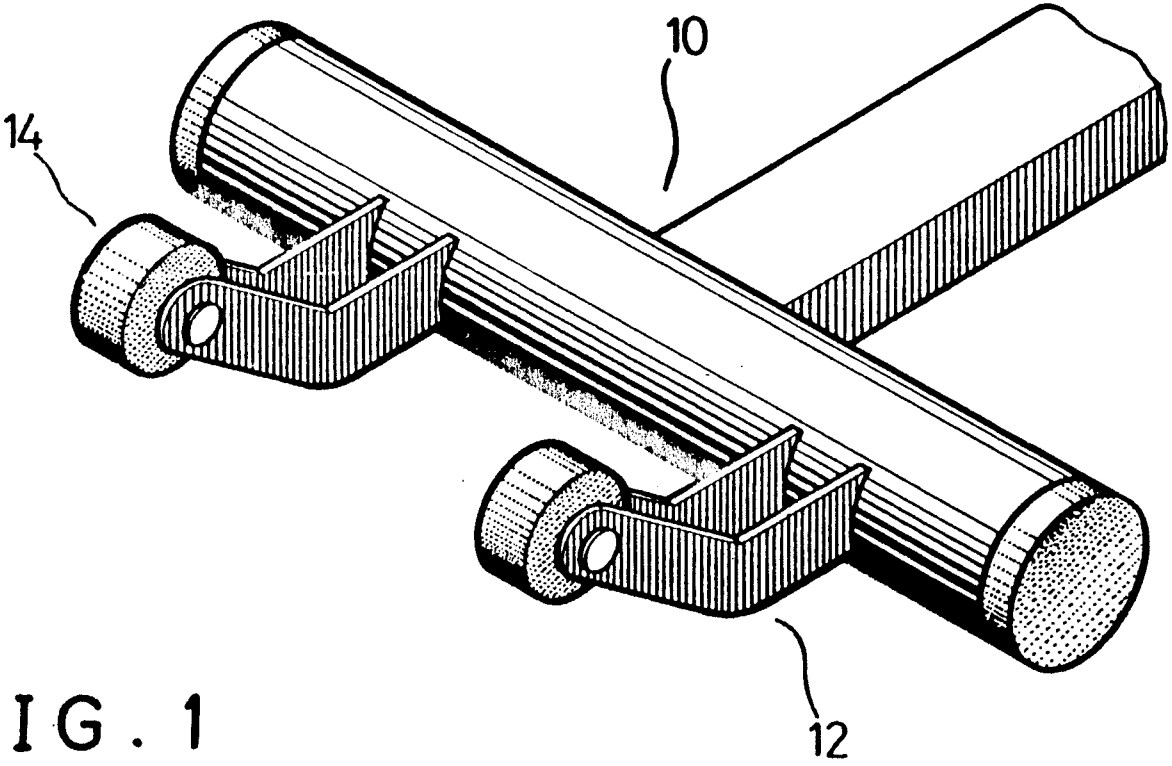
FIG. 1 (Prior Art)
FIG. 1 is an elevational view of an exercising machine carrying wheel assembly according to the prior art.
Figure 2:
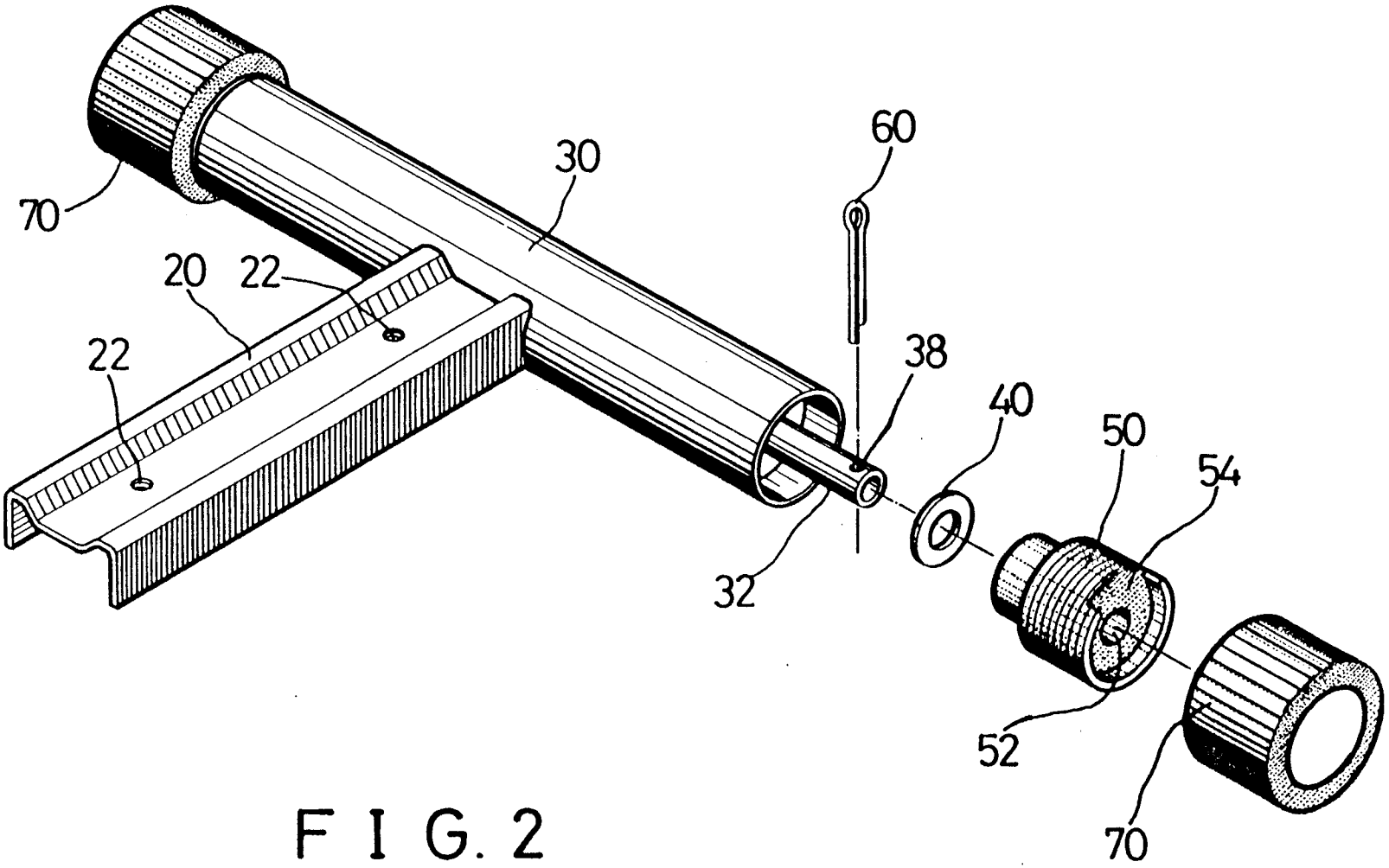
FIG. 2 is an exploded view of an exercising machine carrying wheel assembly according to the present invention.
Figure 3A:
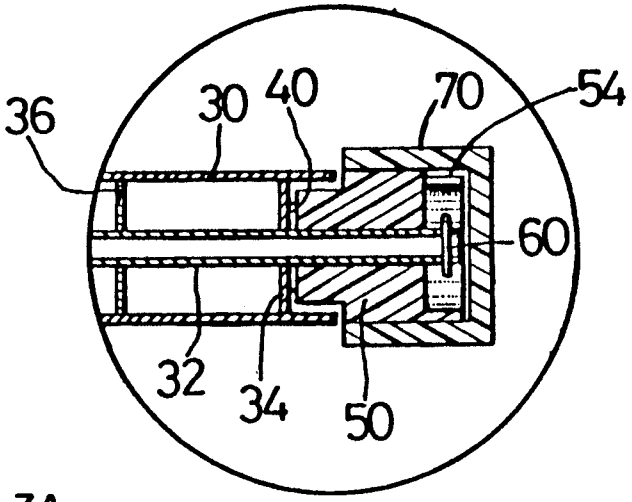
FIG. 3 is an elevational view (and a partly sectional view in an enlarged scale) of the exercising machine carrying wheel assembly of FIG. 2.
Figure 3:
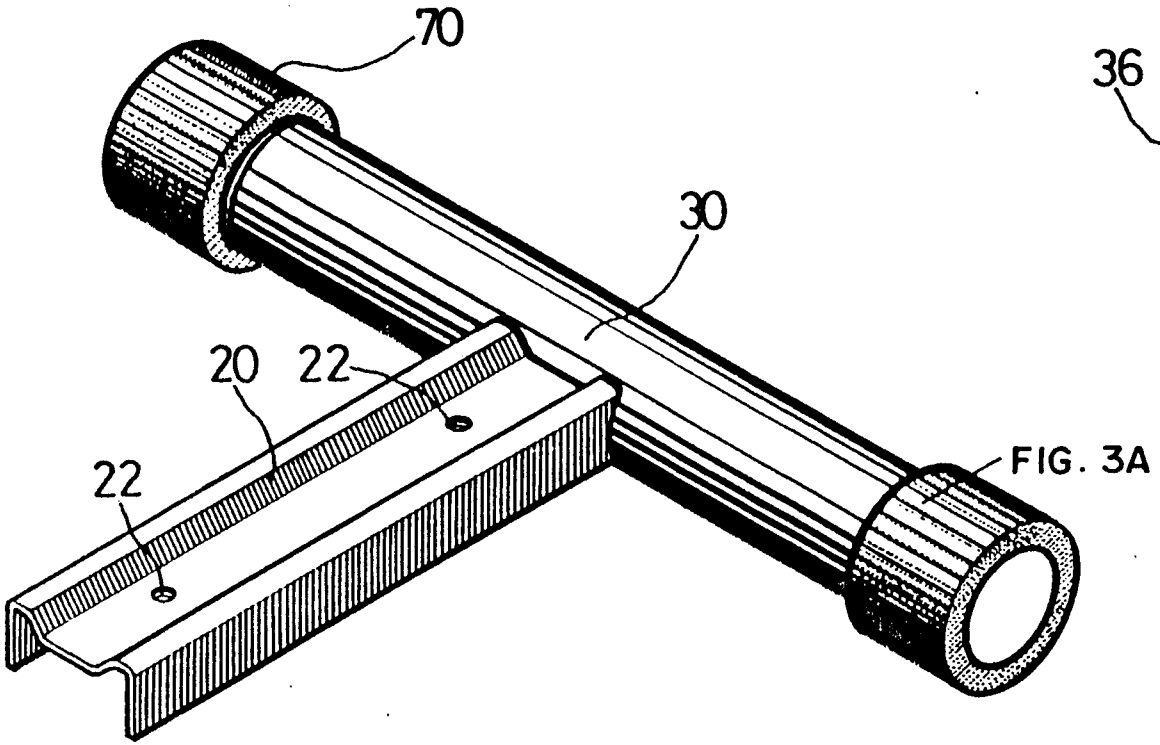

Referring to FIGS. 2 and 3, an exercising machine carrying wheel assembly in accordance with the present invention is generally comprised of a mounting frame 20, a tubular wheel frame 30, washers 40, wheels 50, cotter pins 60, and protective caps 70.

The tubular wheel frame 30 has a middle part welded to the mounting frame 20 perpendicularly, and two central shafts 32 aligned at two opposite ends longitudinally. Each central shaft 32 is respectively supported within the tubular wheel frame 30 by two spaced inside flanges 34,36. The inside flanges 34,36 are welded to the inside wall of the tubular wheel frame 30 and spaced from either end of the tubular wheel frame 30 at a suitable distance. The outer end of either central shaft 32 extends out of the tubular wheel frame 30 at a suitable distance to hold a wheel 50. The wheel 50 is made in the shape of a stepped cylinder having a longitudinal center axle hole 52, through which either central shaft 32 is inserted, and an opening 54 on its periphery, through which a cotter pin 60 is inserted into a pin hole 38 on the respective central shaft 32 to lock the wheel 50 in place. A washer 40 is mounted on each central shaft 32 and retained between the wheel 50 and a respective inside flange 34. During the assembly process, the small outer diameter of the wheel 50 is inserted in the tubular wheel frame 30, and its bigger outer diameter is extended out of the tubular wheel frame 30 with a small gap retained therebetween. When assembled, a cap 70 is respectively covered on the wheel 50 at either end of the tubular wheel frame 30.

Further, the mounting frame 20 is made from a channel bar having screw holes 22. By means of the mounting frame 20, the wheel assembly can be conveniently fastened to the base of an exercising machine by screws.

Figure 4:
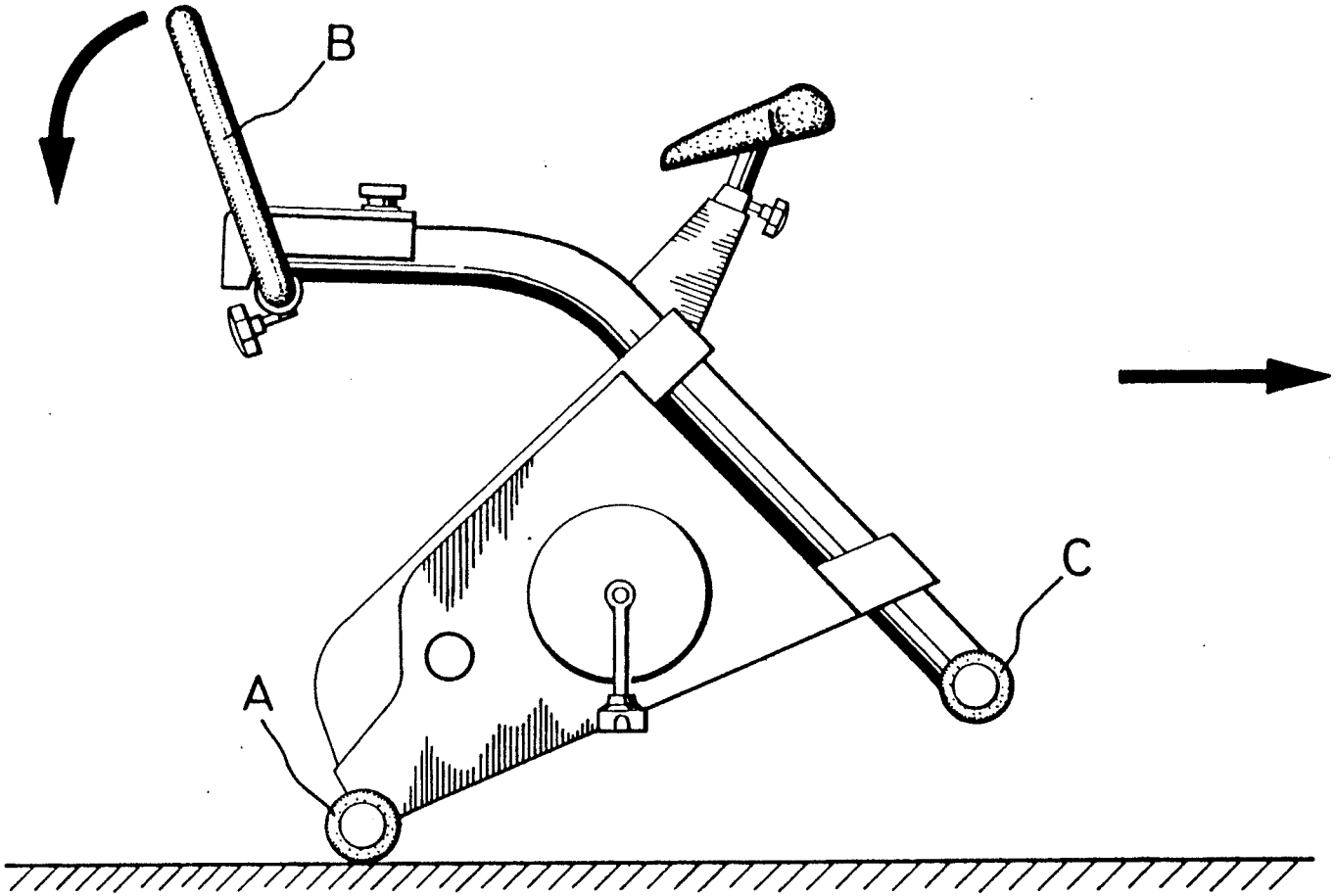
FIG. 4 shows an exercising machine carried on an exercising machine carrying wheel assembly according to the present invention.

Referring to FIG. 4, therein illustrated is an exercising machine equipped with an exercising machine carrying wheel assembly A according to the present invention. The front end C of the exercising machine can be conveniently lifted from the ground by pulling the handle B of the exercising machine backwards downwards against the wheel assembly A. Therefore, the center of gravity of the exercising machine becomes shifted to the wheel assembly A, and the exercising machine can thus be moved from place to place conveniently.

As the wheel 50 at either end of the tubular wheel frame 30 is being rotated, the protective cap 70 is simultaneously carried to rotate. When the exercising machine is placed on the ground and being operated, the front bottom end C produces a friction force against the ground to keep the exercising machine in position.

What is claimed is:

1. An exercising machine carrying wheel assembly fastened to either end of the base of an exercising machine for permitting said exercising machine to be carried on the wheel frame assembly by lifting the other end of the base from the ground, the wheel frame comprising:

a mounting frame fastened to the base of said exercising machine;

a tubular wheel frame welded perpendicularly to the middle of said mounting frame, said tubular wheel frame having two central shafts longitudinally aligned at two opposite ends and respectively supported by two spaced inside flanges, each central shaft having an outer end extended out of said tubular wheel frame, the outer end of either central shaft having a pin hole;

two wheels respectively mounted on said central shafts and locked in place by cotter pins, each wheel being made from a stepped cylinder having a longitudinal center hole, through which either central shaft is inserted, and an opening on a respective periphery, through which either cotter pin is inserted into the pin hole on the respective central shaft;

washers respectively mounted on either central shaft and retained between either wheel and a respective adjacent inside flange; and a cap mounted on each wheel.

2. The exercising machine carrying wheel assembly of claim 1 wherein said mounting frame is made from a channel bar having a plurality of screw holes for mounting.

* * * * *